US009107477B2

(12) United States Patent
Zadeh

(10) Patent No.: US 9,107,477 B2
(45) Date of Patent: Aug. 18, 2015

(54) STILETTO HEEL PROTECTOR

(71) Applicant: Parsa T. Zadeh, Beverly Hills, CA (US)

(72) Inventor: Parsa T. Zadeh, Beverly Hills, CA (US)

( * ) Notice: Subject to any disclaimer, the term of this patent is extended or adjusted under 35 U.S.C. 154(b) by 345 days.

(21) Appl. No.: 13/786,843

(22) Filed: Mar. 6, 2013

(65) Prior Publication Data

US 2014/0250736 A1 Sep. 11, 2014

(51) Int. Cl.

| | |
|---|---|
| ***A43B 21/24*** | (2006.01) |
| ***A43B 21/22*** | (2006.01) |
| ***A43B 23/30*** | (2006.01) |
| ***A43C 15/04*** | (2006.01) |

(52) U.S. Cl.

CPC ..... *A43B 21/22* (2013.01); *A43B 21/24* (2013.01); *A43B 23/30* (2013.01); *A43C 15/04* (2013.01)

(58) Field of Classification Search

CPC ..... A43B 3/166; A43B 3/20; A43B 23/30; A43B 21/24; A43B 21/22; A43B 21/26; A43C 13/00; A43C 15/04

USPC ..... 36/72 R

See application file for complete search history.

(56) References Cited

U.S. PATENT DOCUMENTS

| | | | | |
|---|---|---|---|---|
| 1,439,104 | A * | 12/1922 | Helwitz | 36/72 B |
| 1,875,806 | A | 9/1932 | Givens | |
| 2,875,534 | A | 3/1959 | Grossman | |
| 3,122,848 | A * | 3/1964 | Grossman | 36/7.3 |
| 3,439,435 | A * | 4/1969 | Gaston | 36/72 R |
| 4,498,252 | A | 2/1985 | Connors | |
| 5,311,675 | A * | 5/1994 | Topel | 36/72 B |
| 7,971,373 | B2 | 7/2011 | Epping | |
| 8,033,035 | B2 * | 10/2011 | Brown et al. | 36/72 B |
| 8,424,224 | B2 * | 4/2013 | Hampton | 36/72 B |
| 2002/0133980 | A1 * | 9/2002 | Pan | 36/100 |
| 2008/0148606 | A1 | 6/2008 | Brown et al. | |
| 2008/0196279 | A1 * | 8/2008 | Epping | 36/72 B |
| 2009/0282702 | A1 | 11/2009 | Brown et al. | |
| 2011/0314704 | A1 * | 12/2011 | Naismith-Beeley | 36/34 R |

FOREIGN PATENT DOCUMENTS

| | | |
|---|---|---|
| DE | 1867331 | 2/1963 |
| EP | 2311342 | 4/2011 |
| GB | 1.080.846 | 8/1967 |
| GB | 2.214.053 | 8/1989 |
| GB | 2.428.177 | 1/2007 |

* cited by examiner

*Primary Examiner* — Jila M Mohandesi

(74) *Attorney, Agent, or Firm* — Michael I. Kroll

(57) ABSTRACT

A heel guard detachably mountable onto a heel post of a high heel shoe extends the heel post pressure area, while moving over rough terrain preventing the heel post from sinking into soft surfaces. The heel guard comprises a base portion and an upper portion. The base portion dissipates the heel post pressure while the upper portion frictionally grips the heel post. The upper portion projects from the base portion in a curvilinear fashion into a plurality of stays that converge forming an aperture before extending into the upper portion interior. The upper portion can also be an hourglass columnar receptacle with a bore that tapers from a wide opening to a narrower middle section then to a wider base. The narrower middle section frictionally grips heel posts of varying thicknesses.

7 Claims, 14 Drawing Sheets

STILETTO HEEL PROTECTOR

BACKGROUND OF THE INVENTION

1. Field of the Invention

The present invention relates generally to shoes and, more specifically, to guards that are detachably mountable onto the post of women's high heels to extend the heel pressure area while moving over rough terrain and to prevent the heel from sinking into soft surfaces.

The heel guard comprises a base portion and an upper portion with the base portion made of a rigid material that will dissipate the heel pressure across the base while the upper portion is designed to frictionally grip the heel post.

Preferably, the upper portion is manufactured from a polymeric and/or elastomeric material that projects from the base in curvilinear fashion into a plurality of stays that converge forming an aperture before extending into the upper portion interior.

Furthermore, the present invention provides for an upper portion columnar receptacle with a bore manufactured from an elastomeric or polymeric material that tapers from a wide opening to a narrower middle section then to a wider base, much like an hourglass with the narrower middle section forming the frictional element for heel posts of varying thicknesses.

2. Description of the Prior Art

There are other heel support device designed for high heels. Typical of these is U.S. Pat. No. 1,875,806 issued to Givens on Sep. 6, 1932

Another patent was issued to Fredon on Apr. 22, 1969 as U.S. Pat. No. 3,439,435. Yet another U.S. Pat. No. 4,498,252 was issued to Connors on Feb. 12, 1985 and still yet another was issued on May 17, 1994 to Topel as U.S. Pat. No. 5,311,675

Another patent was issued to Brown et al. on Jun. 26, 2008 as U.S. Patent Application No. 2008/0148606 Yet another U.S. Pat. No. 7,971,373 was issued to Epping on Jul. 5, 2011 Another was issued to Brown et al. on Oct. 11, 2011 as U.S. Pat. No. 8,033,035 and still yet another was issued on Feb. 14, 1963 to Wunderle as Germany Patent No. DE1867331.

Another patent was issued to Fredon on May 26, 1966 as U.K. Patent No. GB1,080,846 Yet another EU Patent No. EP2311342 was issued to Bertrand on Apr. 20, 2011.

U.S. Pat. No. 1,875,806

Inventor: Albert W. Givens

Issued: 30 Jun. 1931

The invention is a detachable enlarged wearing surface for spike heels, comprising a circular tread member integral with a conical heel embracing member having tapered concave sides and a central opening conforming in shape to a cross section of the spike heel, and a metallic disk of greater area than the spike heel secured within said tread between the shoe heel and the wearing surface at an angle thereto.

U.S. Pat. No. 3,439,435

Inventor: Pierre Andre Gaston Fredon

Issued: 22 Apr. 1969

Disclosed is the combination of a stiletto heel having a tip of material adapted to be attracted by magnetic forces, with a protector which comprises a cup-like device having (1) a wall portion adapted to surround a lower portion of the heel, and (2) an end closing portion, said cup-like device incorporating permanent magnet means for producing a magnetic force adapted to clamp the end closing portion to the tip.

U.S. Pat. No. 4,498,252

Inventor: Paul E. Connors

Issued: 12 Feb. 1985

A footwear protector with a shield portion which is a generally U-shaped wall with an open front adapted to follow the general contour of the heel and a suitable portion of the backside of the footwear. The first heel binding strap portion projects outwardly from the lateral edges of the shield portion forming a loop at the base of the shield which loop resiliently fastens around about the heel and embraces the heel breast. A heel stop portion at the base of the shield locates the heel and prevents the shield from riding up the heel. A second heel binding strap portion extends across the saddle of the shield and performs the same function as the first binding strap for heels too small to be bound by the first strap. Extending inward from the back of the shield and spaced above the base of the heel is a tab means. The tab means performs the function of a binding strap for heels with significantly reduced cross section such as spiked and high heels. The protector is a single molded piece of elastic material which can be modified by its user to conform to the heel's size of the target of the footwear. It is modified by the use of common household shears.

U.S. Pat. No. 5,311,675

Inventor: Tracy L. Topel

Issued: 17 May 1994

A shoe cap arranged for securement to and for reception of a lady's high heel shoe permitting extended support of the shoe for traverse of water moistened and soft turf.

U.S. Patent Application Number 2008/0148606

Inventor: Rebecca Brown et al

Published: 26 Jun. 2008

A stabilizing and support accessory is provided for a stiletto heel. A base plate, having a surface contact area significantly greater than that of the heel, is mounted underneath the heel by means of a simple, clip-on attachment, such that the attachment can be easily and quickly mounted on a heel for walking over soft or uneven surfaces, and also quickly removed when not needed. A preferred clip-on attachment is formed of a section of spring steel shaped into an upwardly opening, U-shaped clip and a horizontally opening clip integrally extending from one element of the upwardly opening clip. An alternative form, formed primarily of plastic, is attached by a single, horizontally disposed clip gripping the heel. The accessories are sufficiently inexpensive that they may be discarded after use, as after walking on muddy surfaces, for example.

U.S. Pat. No. 7,971,373

Inventor: Astrid Epping

Issued: 5 Jul. 2011

A support sleeve for high heels on ladies shoes with a sleeve body to accommodate a heel, the sleeve body having a substantially larger base than the base of the heel to be accommodated, and a fixing arrangement (36, 38, 46) for attaching it to the heel.

U.S. Pat. No. 8,033,035

Inventor: Rebecca P. Brown et al

Issued: 11 Oct. 2011

A slip-on, slip-off stabilizing support accessory for a stiletto heel. The device is a unitary molding of semi-rigid, resilient plastic material formed with a generally hourglass configuration, with outwardly concave, resiliently flexible side walls for frictionally engaging opposite sides of a stiletto heel. An outwardly flared top opening facilitates application of the device to the heel, while an outwardly flaring bottom configuration provides a greatly enlarged ground contact area. Front and back edges of the side walls are of outwardly concave shape. Front and back wall structures, formed by relatively narrow, spaced-apart elements, enable the side walls to be flexed for easy application to heels of various sizes, while firmly gripping heels of the smallest size.

Germany Patent Number DE1867331

Inventor: Franz Wunderle

Issued: 14 Feb. 1963

The invention discloses an easily removable rubber cap for ladies shoes to protect against spiked heel pressure point in floors.

U.K. Patent Number GB1,080,846

Inventor: Pierre Andre Gaston Fredon

Published: 23 Aug. 1967

An attachment for the heels of ladies' shoes, e.g. of the "stiletto" type, to prevent damage to floors consists of a permanent magnet arranged to adhere magnetically to the steel tip of the heel and a cap e.g. of thermoplastic resin which surrounds the magnet and at least a lower part of the heel. In a first embodiment the cap is additionally secured to the heel by a locking ring which forces a tapered portion which is lined with felt against the heel. In a modification, the cap has vertical slits, which enable it to extend over the wider part of heel, and an external screw thread. An internally threaded ring is screwed over the cap to clamp the cap over the heel. In a second embodiment, the cap merely surrounds the magnet, no additional fastenings being provided. The magnet may be a solid block of ferrite or magnet alloy or may be a compound magnet formed from an annular magnet and a disc of soft iron.

EU Patent Number EP2311342

Inventor: Ruiz De Velasco Inigo

Issued: 20 Apr. 2011

An accessory element for spike heel characterized in that it comprises a platform that houses the tip of said heel, a support wall for said heel placed at the periphery of said platform, and means for detachably fixing said heel to said platform, said fixing means being configured to permit the fixation of said heel next to said support wall so that the tip of the heel is placed off-center in the platform to minimize the torque momentum that receives the platform when walking. With these features the stability and comfort of the user when she walks on soft grounds is enhanced and a detachable accessory element is obtained.

While these heel guards may be suitable for the purposes for which they where designed, they would not be as suitable for the purposes of the present invention as heretofore described.

It is thus desirable to provide a heel guard having a rigid base with a vertically projecting receptacle for accommodating and gripping the post of high heel shoes that can easily be mounted onto and removed from the heel post without marring or scratching the post.

It is further desirable to provide a heel guard having an upper portion extending from a base portion having a plurality of bow-like stays converging into a pliable aperture that accommodates and grips the post of a high heel shoe.

SUMMARY OF THE PRESENT INVENTION

A primary object of the present invention is to provide a heel guard for high heel shoes, such as stiletto heels, that will prevent the heel from sinking into soft ground.

Another object of the present invention is to provide a heel guard for high heel shoes that once mounted onto the heel provides a greater heel surface while moving over rough terrain, such as graveled surfaces.

Yet another object of the present invention is to provide a heel guard that is easily mounted onto and removed from the heel post of high heel shoes without marring the surface of the shoes.

Still yet another object of the present invention is to provide a heel guard having a base portion and an upper portion.

An additional object of the present invention is to provide a base portion manufactured from a rigid polymeric and/or elastomeric material that will disperse the pressure placed on the heel over the breadth of the base portion.

A further object of the present invention is to provide a heel guard upper portion structure that encompasses an aperture that receives the heel post of a high heel shoe with the structure frictionally engaging and holding the heel guard to the post of said high heel shoe.

A yet further object of the present invention is to provide a heel guard wherein said base portion has a top surface and a bottom surface with said top surface having a substantially centered rimmed receptacle for receiving the heel of a high heel shoe therein.

A still yet further object of the present invention is to provide a base portion having an interiorly positioned peripheral ridge forming seat for an upper portion.

Another object of the present invention is to provide a base portion with said peripheral ridge having a plurality of outwardly projecting flanges each having a lip for engaging correspondingly located catches within the heel guard's upper portion.

Yet another object of the present invention is to provide a heel guard wherein said base portion optionally provides a bottom surface having a textured surface forming a heel guard ground engaging frictional surface.

Still yet another object of the present invention is to provide a base portion having a geometric shape with an upper portion extending therefrom, An additional object of the present invention is to provide a base portion having an irregular shape with an upper portion extending therefrom, A further object of the present invention is to provide a heel guard having an upper portion that project from the periphery of the base portion.

A yet further object of the present invention is to provide a heel guard having an upper portion with a base having a smaller footprint that the base portion.

A still yet further object of the present invention is to provide a heel guard having an upper portion that projects from the base in curvilinear fashion into a plurality of stays that converge forming an aperture before extending into the upper portion interior.

An additional object of the present invention is to provide a heel guard having a concave shape on the terminal ends of said stay.

A further object of the present invention is to provide a heel guard having a plurality of post-like supports extending between the bow-like stays and base portion.

A yet further object of the present invention is to provide a heel guard further providing panel-like structure extending between the post-like supports and terminal ends of said stays to prevent puckering of the stays as the heel post is removed from the heel guard.

A still yet further object of the present invention is to provide a heel guard that will accommodate heel posts of varying thicknesses by virtue of the pliable stays.

Additional objects of the present invention will appear as the description proceeds.

The present invention overcomes the shortcomings of the prior art by providing a heel guard having a base portion made of a rigid material that will distribute heel pressure during use across the breadth of the base and an upper portion forming a heel post receptacle that frictionally grips the heel post preferably by a plurality of pliable bow-like stays having interior support structure engaging a rimmed heel receptacle forming an integral part of the base portion that will prevent puckering of the stays as the heel guard is removed from the heel post.

The foregoing and other objects and advantages will appear from the description to follow. In the description reference is made to the accompanying drawing, which forms a part hereof, and in which is shown by way of illustration specific embodiments in which the invention may be practiced. These embodiments will be described in sufficient detail to enable those skilled in the art to practice the invention, and it is to be understood that other embodiments may be utilized and that structural changes may be made without departing from the scope of the invention. In the accompanying drawing, like reference characters designate the same or similar parts throughout the several views.

The following detailed description is, therefore, not to be taken in a limiting sense, and the scope of the present invention is best defined by the appended claims.

BRIEF DESCRIPTION OF THE DRAWING FIGURES

In order that the invention may be more fully understood, it will now be described, by way of example, with reference to the accompanying drawing in which.

DESCRIPTION OF THE REFERENCED NUMERALS

Figure 1:
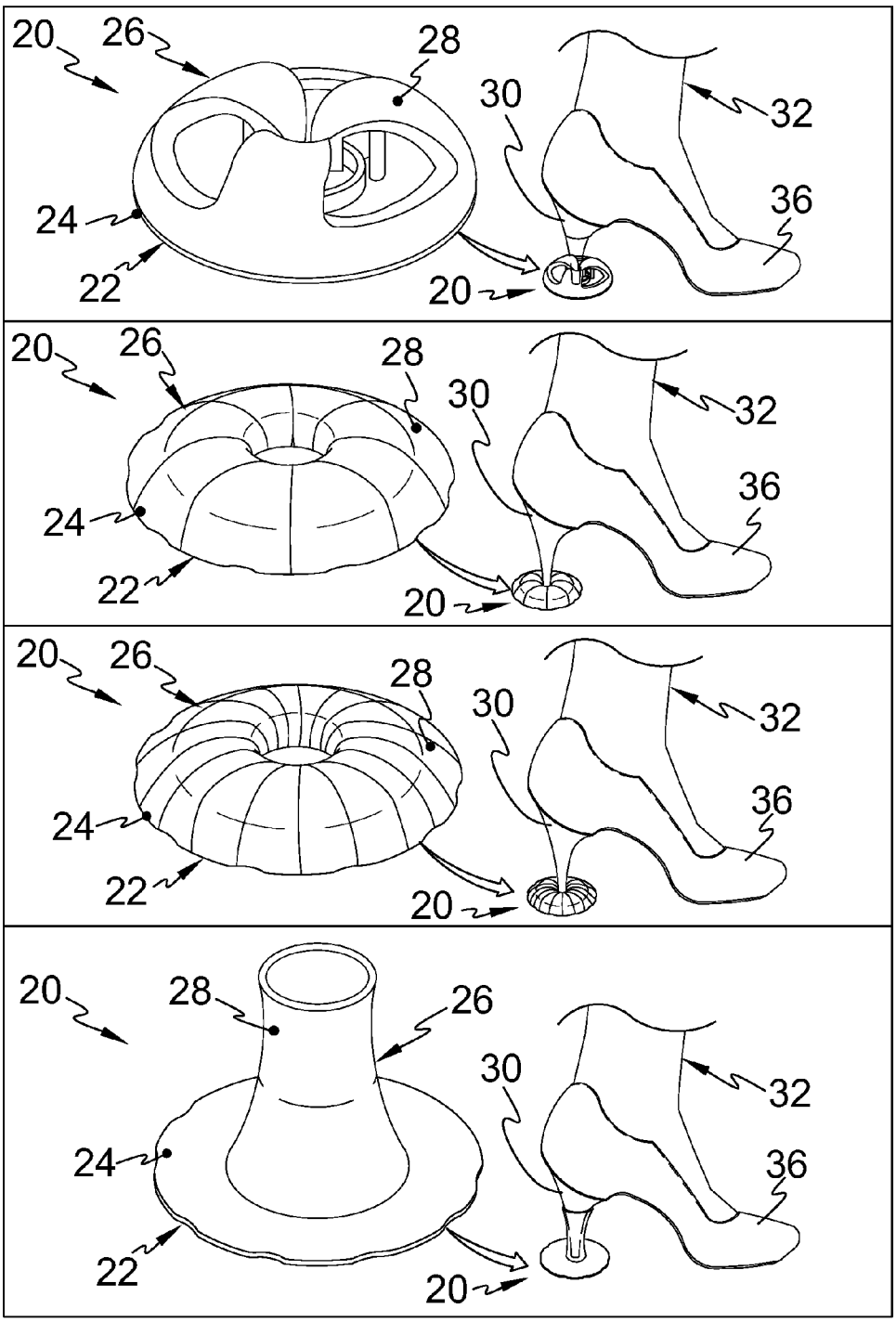
FIG. 1 is an illustrative chart of embodiments of the heel guard of the present invention.

Turning now descriptively to the drawings, in which similar reference characters denote similar elements throughout the several views, the Figures illustrate the heel guard of the present invention. With regard to the reference numerals used, the following numbering is used throughout the various drawing figures.

20 heel guard
22 base portion of heel guard 20
24 rigid material of base portion 22
26 upper heel clutch portion of heel guard 20
28 polymeric material of upper portion 26
30 heel post of shoe 36
32 user of shoe 36
36 shoe
38 bottom surface of base portion 22
40 nodules/texture on bottom surface 38
42 flexible material end tip of upper portion 26
44 top side of base portion 22
46 rimmed heel receptacle on top side 44
48 peripheral circumferential ridge on top side 44
50 transverse flange on ridge 48
52 flange tip on flange 50
54 lower peripheral edge of upper portion 26
56 hook-like catch on edge 54
57 curvilinear tongue-like stay of upper portion
58 pliable stay support of stay 57
60 heel guard housing for upper portion 26
62 aperture in housing 60
64 radial slip in housing 60

66 curvilinear section of housing 60
68 heel receptacle for upper portion 26
70 curvilinear wall in heel receptacle 68

DETAILED DESCRIPTION OF THE PREFERRED EMBODIMENT

The following discussion describes in detail one embodiment of the invention (and several variations of that embodiment). This discussion should not be construed, however, as limiting the invention to those particular embodiments, practitioners skilled in the art will recognize numerous other embodiments as well. For definition of the complete scope of the invention, the reader is directed to appended claims.

Referring to FIG. 1, shown is an illustrative chart of embodiments of the heel guard of the present invention. The present invention is a heel guard 20 having a base portion 22 made of rigid material 24 that will distribute the heel pressure across the base 22 and an upper heel clutch portion 26 made of a shape retentive polymeric material 28 that will grip the post 30 of the heel without marring the post texture. The device is inserted onto the shoe heel post 30 providing the user 32 with walking control over soft or rough terrain, such as gravel or soft ground. The heel 30 can be easily pulled out of the heel guard 20 without scratching or damaging the heel post 30 of the shoe 36.

Figure 2:
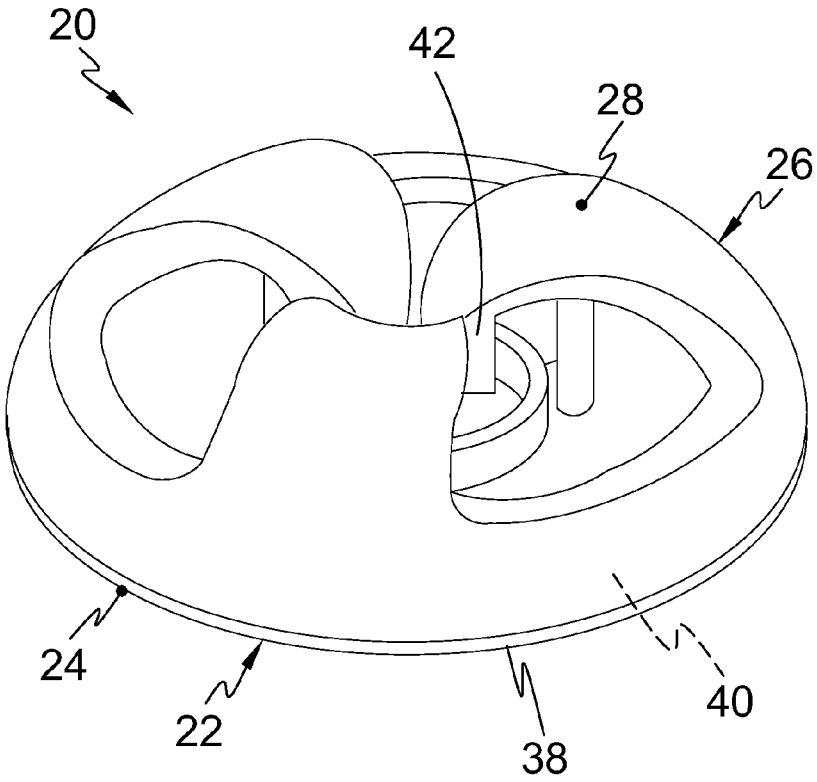
FIG. 2 is an illustrative view of the preferred embodiment of the heel guard of the present invention.

Referring to FIG. 2, shown is an illustrative view of the preferred embodiment of the heel guard of the present invention. The heel guard 20 comprises a base 22 that will dissipate the pressure of a stiletto heel 30 across the heel guard base 22 fundamentally enlarging the heel footprint allowing the wearer 32 to walk over soft ground where a stiletto heel 30 may sink into the ground or on rocky terrain, such as loose gravel, that may imperil the user 32 to grave bodily harm or damage the shoes 36. Furthermore, the heel guard 20 can be fitted onto a stiletto heel 30 to impede slipping on ice by incorporating a bottom surface 38 having nodules or texture 40 serving as a heel guard frictional element. The heel 30 can be easily pulled out of the device without scratching or marring the heel surface due to the inward bends in the flexible material end tips 42, while accommodating a range of heel thickness.

Figure 3:
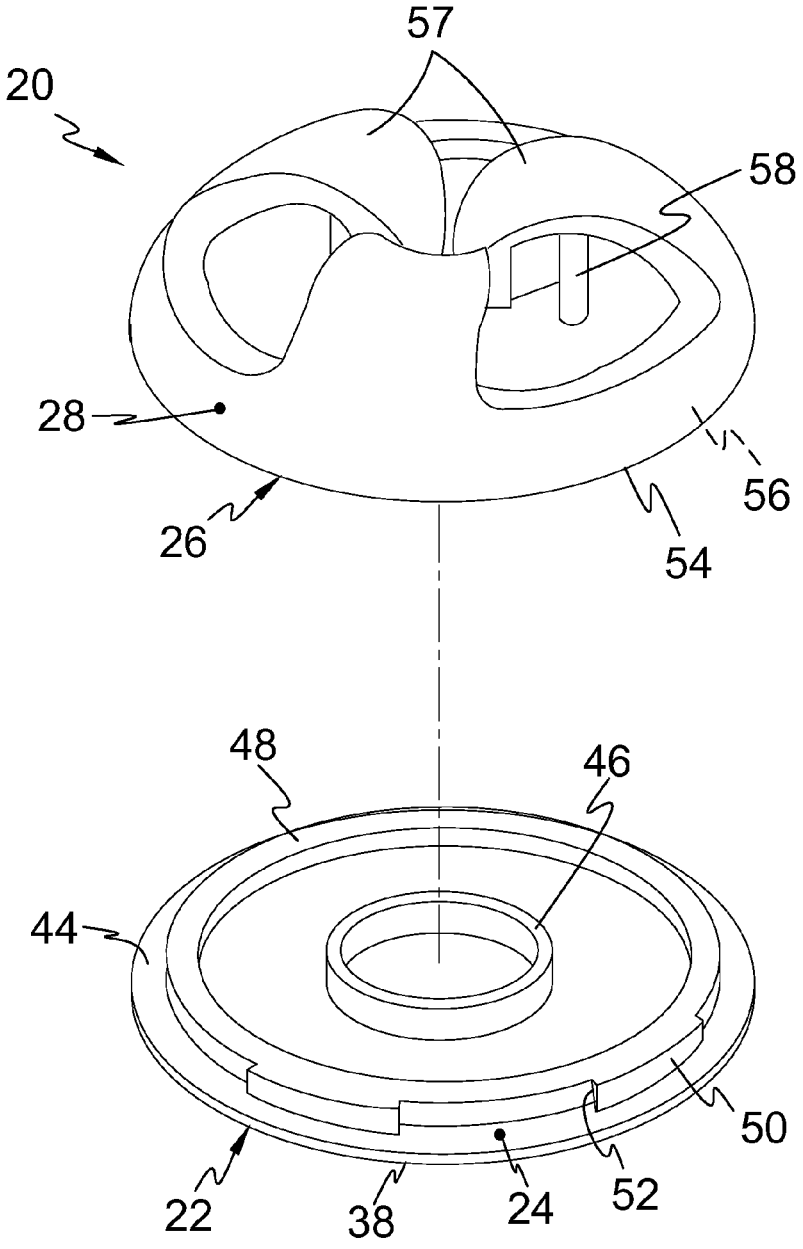
FIG. 3 is an illustrative view of the preferred embodiment of the heel guard of the present invention.

Referring to FIG. 3, shown is an illustrative view of the preferred embodiment of the heel guard of the present invention. The heel guard 20 comprises a heel guard base 22 and heel clutch portion 26 attachable to the base 22. The base 22 has a bottom side 38 and a top side 44 with the top side 44 having a rimmed heel receptacle 46 and a peripheral circumferential ridge 48 with transverse flanges 50 each terminating in a flange lip 52. The heel clutch portion 26 has a lower peripheral edge 54 with hook-like catches 56 that matingly engage the base flange lips 52. The body of the heel clutch portion 26 extends into a plurality of curvilinear tongue-like stays 57 that will frictional engage the heel post 30 when inserted. Each of the tongue-like stays 57 has a pliable stay support 58 that will help maintain the memory retentive stays 57 during the life of the heel guard 20 and accommodate heel posts 30 of varying thickness.

Figure 4:
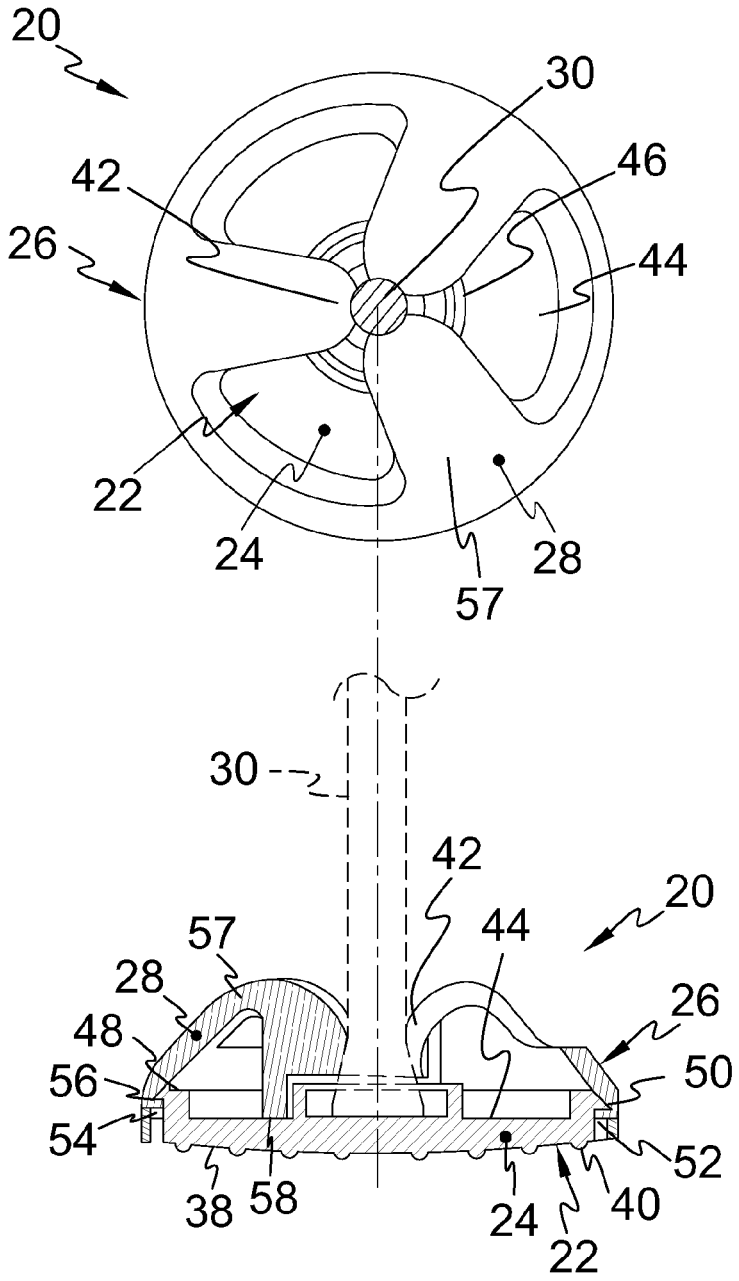
FIG. 4 is an illustrative chart of the preferred embodiment of the heel guard of the present invention.

Referring to FIG. 4, shown is an illustrative chart of the preferred embodiment of the heel guard of the present invention. The present invention is a heel guard 20 having a bottom portion 22 made of a rigid material 24 and a top portion 26 made of a shape retentive polymeric material 28. The device is inserted onto the shoe heel post 30 providing the user 32 with walking control over soft ground. The heel 30 can be easily pulled out of the device without scratching or damage due to the inward bends in the flexible material end tips 42, while accommodating a range of heel thickness.

Figure 5:
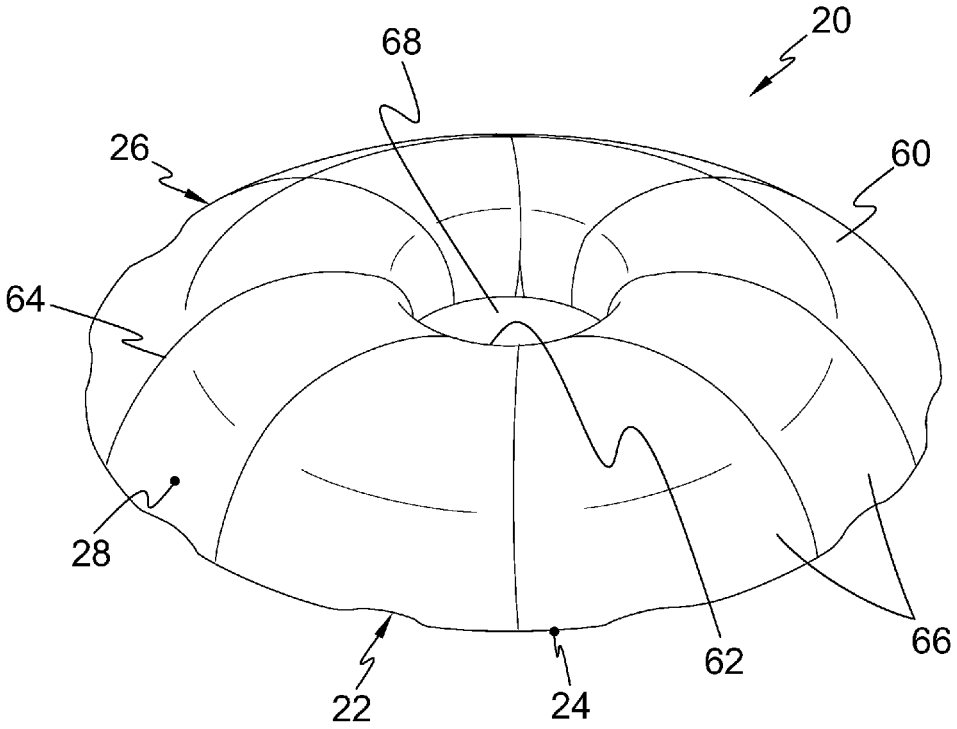
FIG. 5 is a perspective view of an alternate embodiment of the heel guard of the present invention.

Referring to FIG. 5, shown is a perspective view of an alternate embodiment of the heel guard of the present invention. The heel guard 20 of the present invention provides a device mountable onto the heel post 30 of a high heel shoe 36 comprising a heel guard housing 60 providing a heel guard receptacle 62 with a rigid base 22 so that the pressure from a heel tip is distributed across the rigid base 22. The housing 60 further provides an upwardly depending top portion 26 with a top side heel aperture 62 for inserting a heel 30. Illustrated is a top portion 26 that is folded into the interior with a plurality of top portion radial slits 64 extending into the interior dividing the top portion 26 into a plurality of curvilinear sections 66 converging to form the heel aperture 62 then curving into the heel guard receptacle 68.

Figure 6:
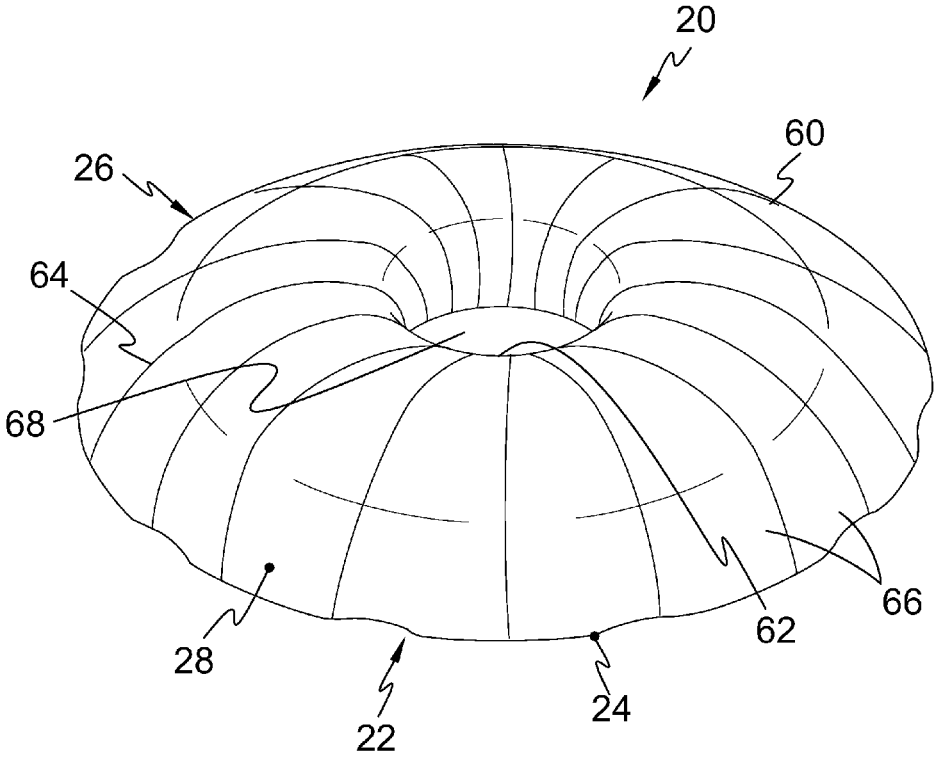
FIG. 6 is a perspective view of another alternate embodiment of the heel guard of the present invention.

Referring to FIG. 6, shown is a perspective view of another alternate embodiment of the heel guard of the present invention. The heel guard 20 of the present invention provides a device mountable onto the heel 30 of a high heel shoe 36 comprising a heel guard housing 60 forming a heel guard receptacle 68 having a rigid base 22 so that the pressure from a heel tip 30 is distributed across the rigid base 22. The housing 60 further provides an upwardly depending top portion 26 with a top side heel aperture 62 for inserting a heel 30. Illustrated is a top portion 26 that is folded into the interior with a plurality of radial slits 64 extending into the interior dividing the top portion 26 into a plurality of curvilinear sections 66 converging to form the heel aperture 62 then curving into the heel guard receptacle 68.

Figure 7:
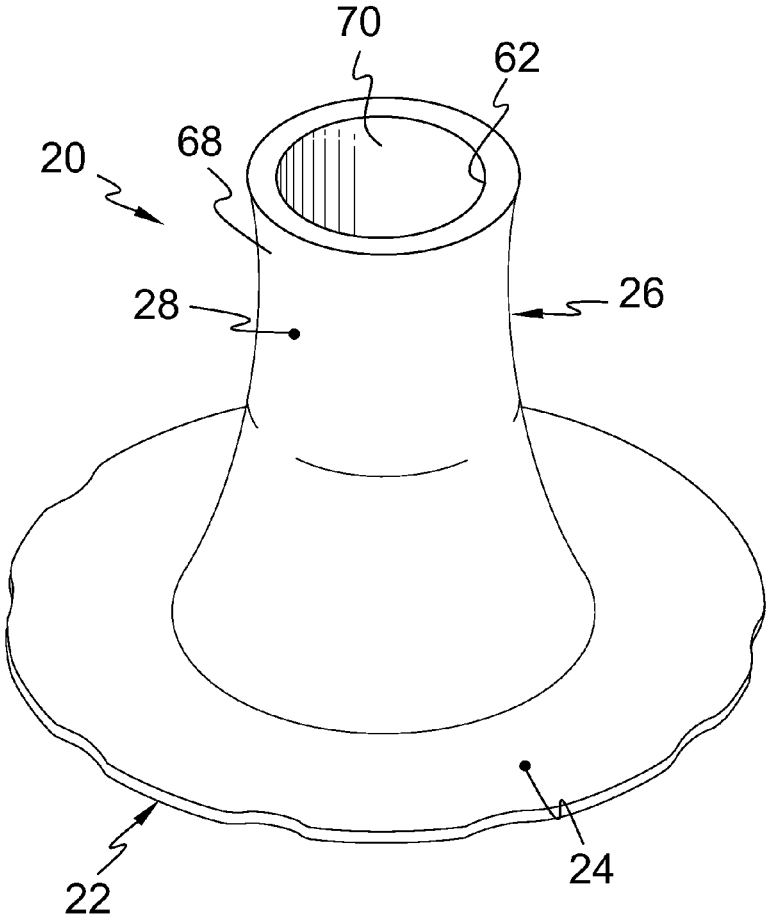
FIG. 7 is a perspective view of yet another embodiment of the heel guard of the present invention.

Referring to FIG. 7, shown is a perspective view of yet another embodiment of the heel guard of the present invention. The heel guard 20 of the present invention provides for a heel guard 20 having a base 22 that radially extends beyond a heel receptacle 68 having a hourglass shape with a midpoint constriction that will frictionally engage a heel post 30. The heel receptacle 68 consists of an upwardly depending top portion 26 with a top side heel aperture 62 for inserting a heel 30. Illustrated is a top portion 26 having a curvilinear wall 70 with a narrower center portion flaring outwardly forming the heel aperture 62. The narrower constriction forms a frictional element for grasping the heel 30 once inserted into the heel guard 20.

Figure 8:
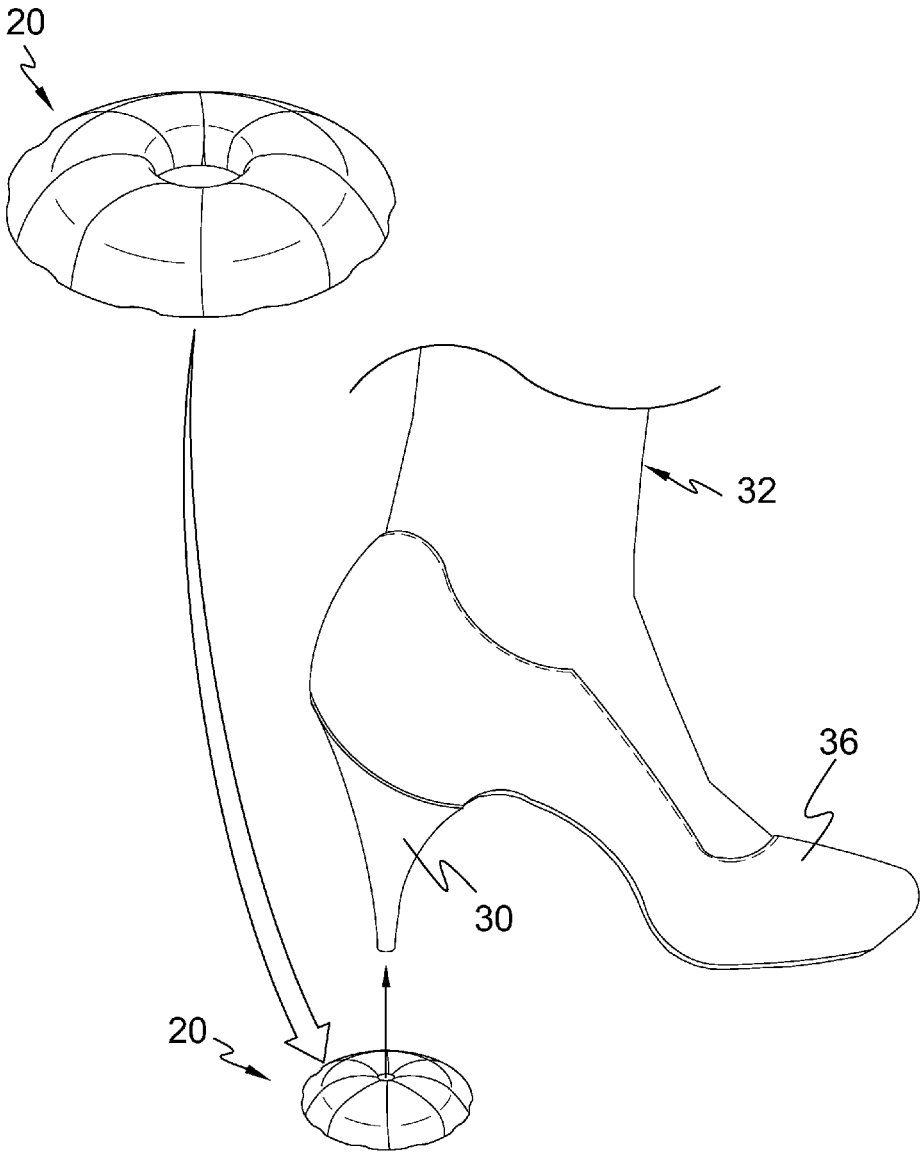
FIG. 8 is an illustrative view of the heel guard of the present invention.

Referring to FIG. 8, shown is an illustrative view of the heel guard of the present invention. The present invention is a heel guard 20 that is inserted onto a shoe heel post 30 to aid the user 32 in walking over soft or uneven surfaces, such as gravel and grass, and to prevent damage to the shoe heel 30, which may sink into the ground endangering the user 32 as well as the shoes 36.

Figure 9:
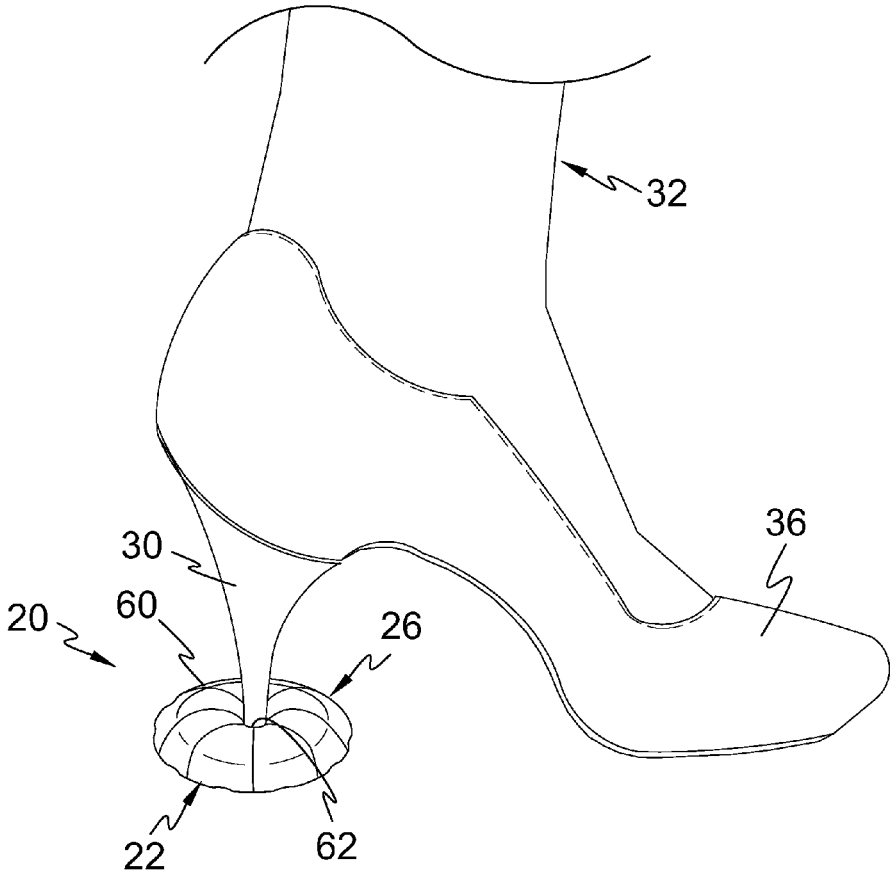
FIG. 9 is an illustrative view of the heel guard of the present invention.

Referring to FIG. 9, shown is an illustrative view of the heel guard of the present invention. The heel guard 20 comprises a heel guard housing 60 having a rigid base 22 with a polymeric top portion 26 having a heel post aperture 62 and shaped to frictionally engage the heel post 30.

Figure 10:
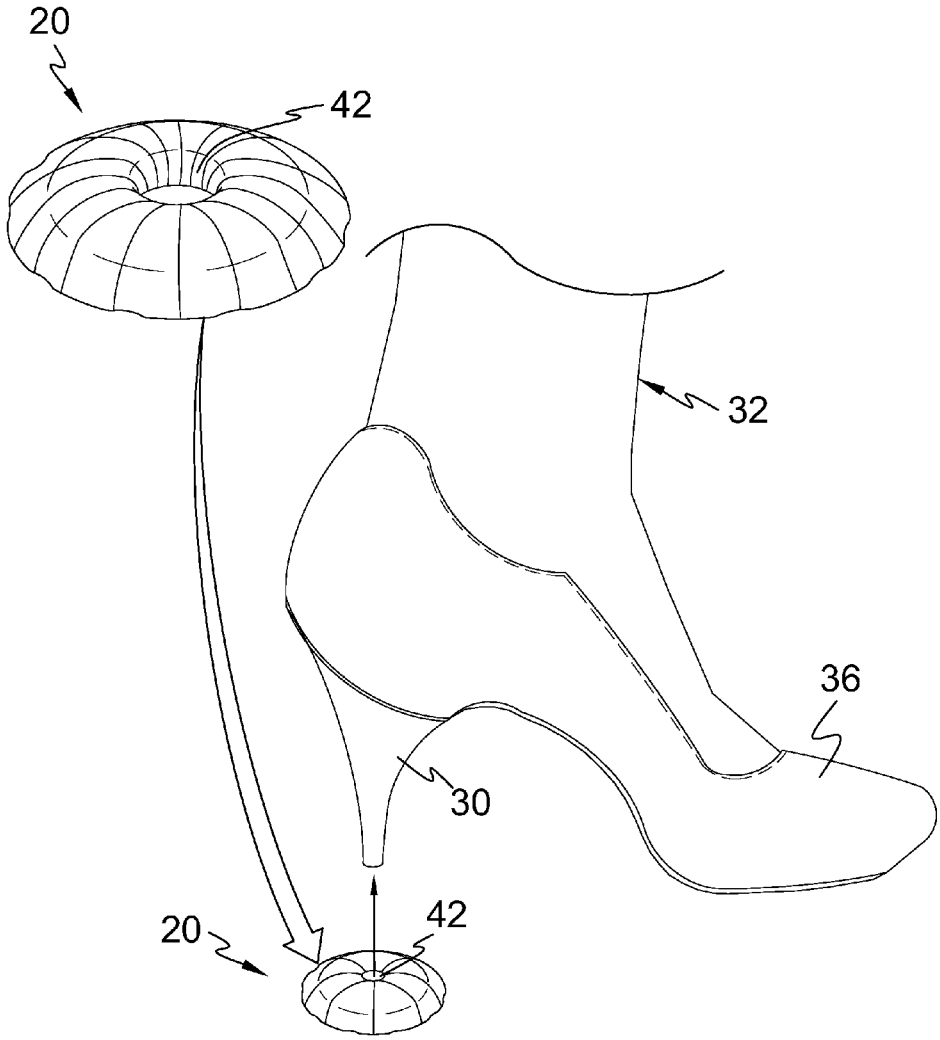
FIG. 10 is an illustrative assembly view of the present invention.

Referring to FIG. 10, shown is an illustrative assembly view of the present invention. The heel guard 20 can be easily pulled out of the heel post 30 without scratching or damage due to the inward bends in the flexible material end tips 42, while accommodating a range of heel thickness.

Figure 11:
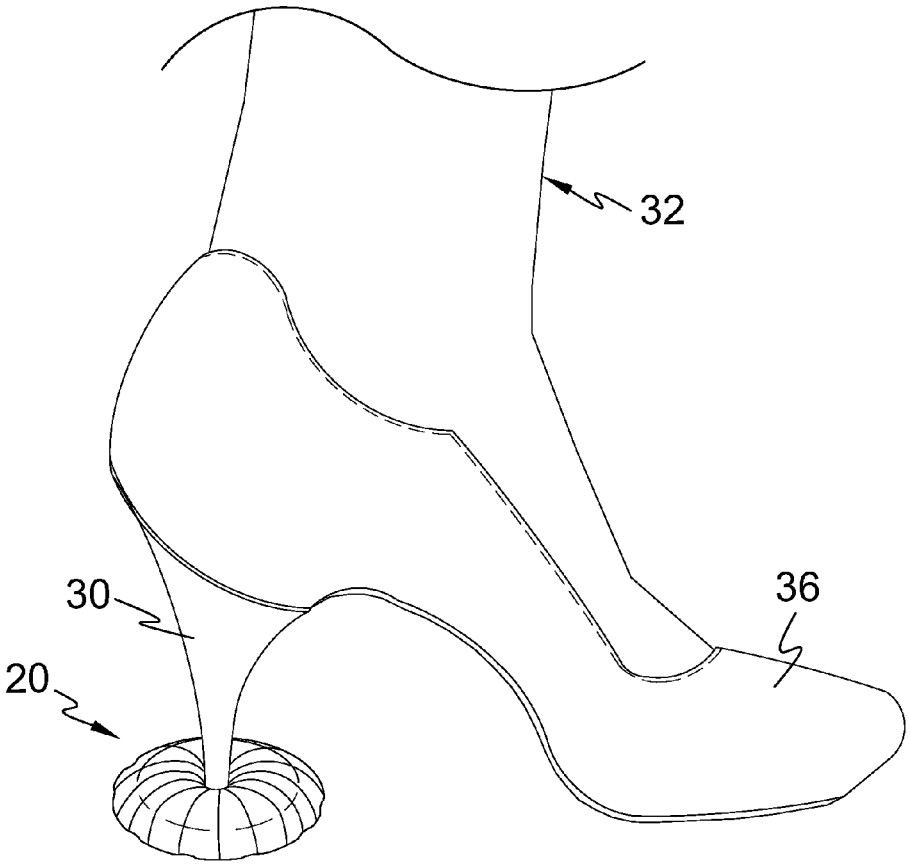
FIG. 11 is an illustrative view of the heel guard of the present invention.

Referring to FIG. 11, shown is an illustrative view of the heel guard of the present invention. The present invention is a heel guard 20 that is inserted onto a shoe heel post 30 to aid the user 32 in walking over soft or uneven surfaces, such as gravel and grass, and to prevent damage to the shoe heel 30, which may sink into the ground endangering the user 32 as well as the shoes 36.

Figure 12:
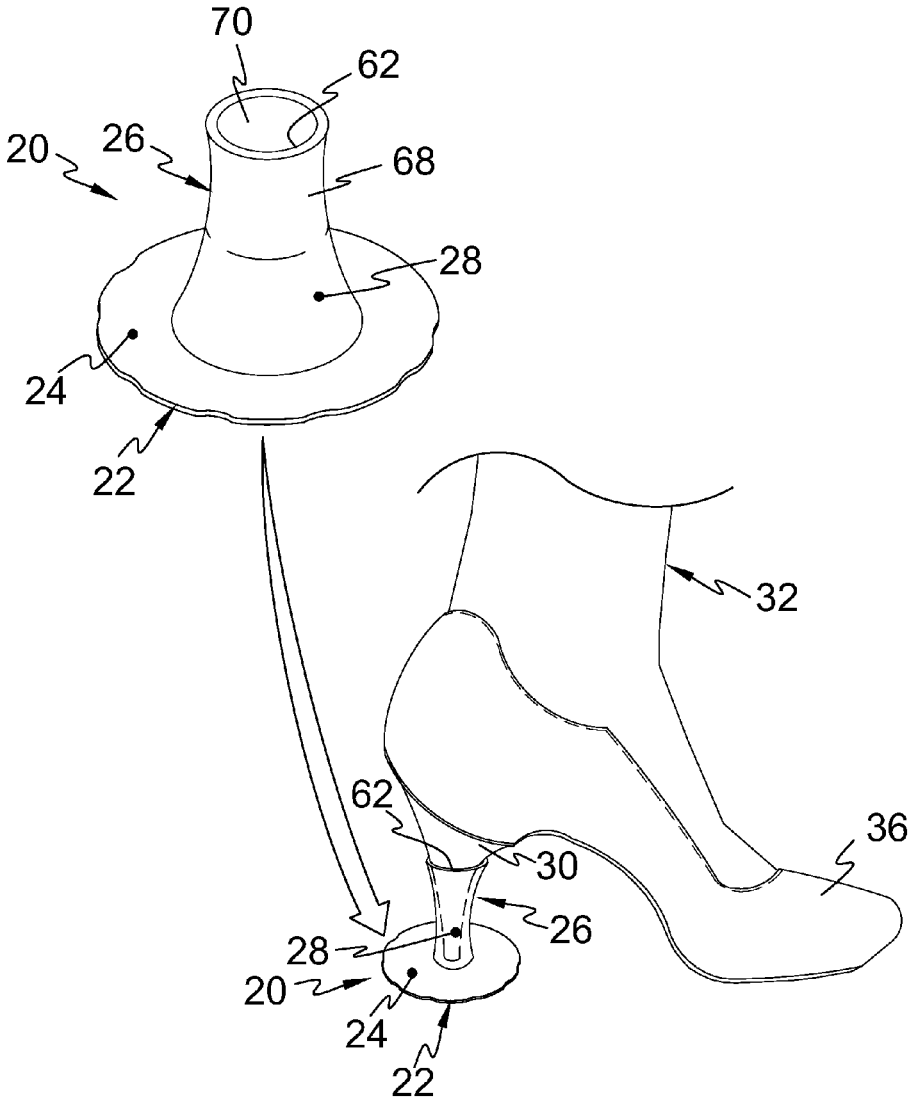
FIG. 12 is a perspective view of another embodiment of the heel guard of the present invention.

Referring to FIG. 12, shown is a perspective view of another embodiment of the heel guard of the present invention. Illustrated is a heel guard 20 for a shoe 36 having a heel post 30. The heel guard 20 has a top portion 26 forming a heel guard receptacle 68 with a rigid base 22, so that the pressure from the heel tip is distributed across the rigid base 22. The heel guard receptacle 68 further provides the upwardly depending top portion 26 terminating in a top side heel aperture 62 for inserting a heel post 30 within the aperture 62. A curvilinear wall 70 with a narrower center portion flaring outwardly to the heel aperture 62, so that the narrower constriction forms a frictional element for grasping the heel 30 once inserted into the heel guard 20.

Figure 13:
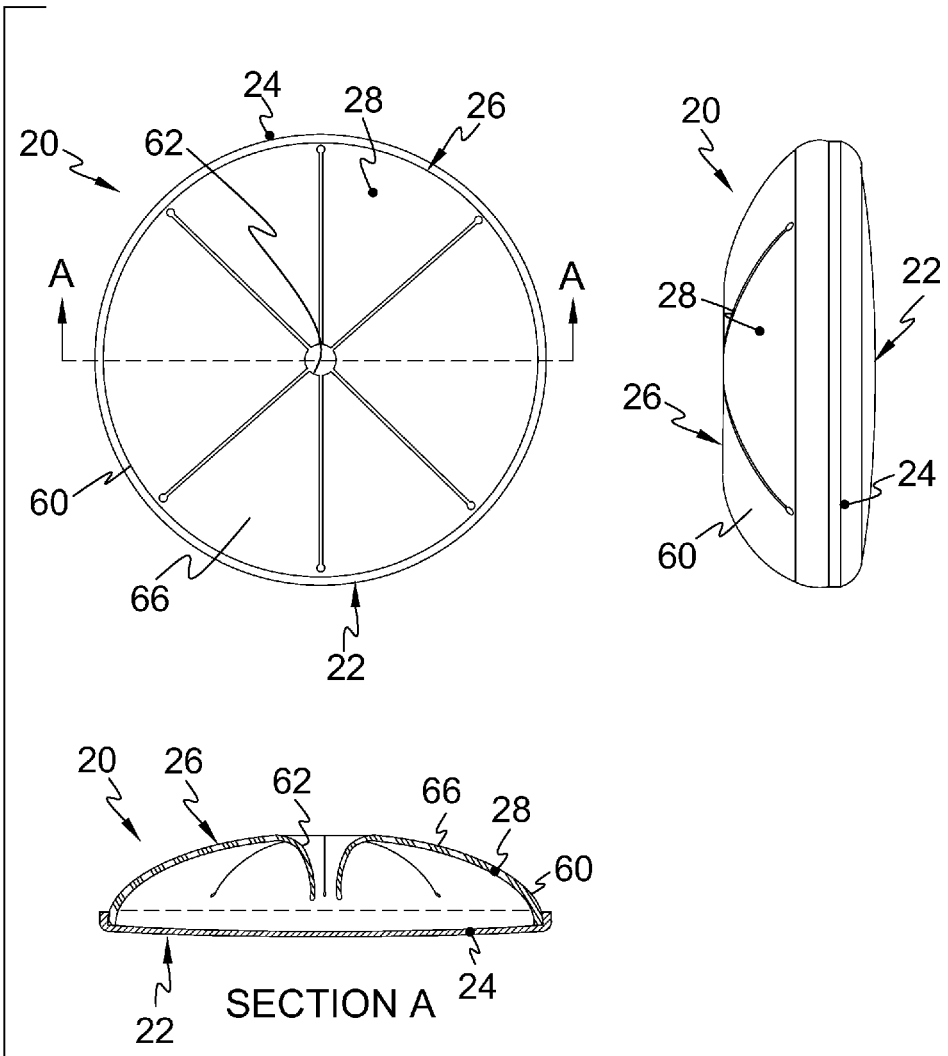
FIG. 13 are plan views of an enablement of the heel guard of the present invention.

Referring to FIG. 13, shown are plan views of an enablement of the heel guard of the present invention. Shown is an enablement of the present invention comprising a heel guard housing 60 manufactured from a polymeric or elastomeric material 28 having a compartment for receiving a heel 30 therein. The present invention provides a housing 60 having various shapes incorporating a base 22 for supporting the heel tip and a top side 26 having a substantially center aperture 62 formed by a plurality of inwardly depending curvilinear sections 66 that frictionally grip the heel 30 when inserted and can be easily removed without scratching or marring the heel 30.

Figure 14:
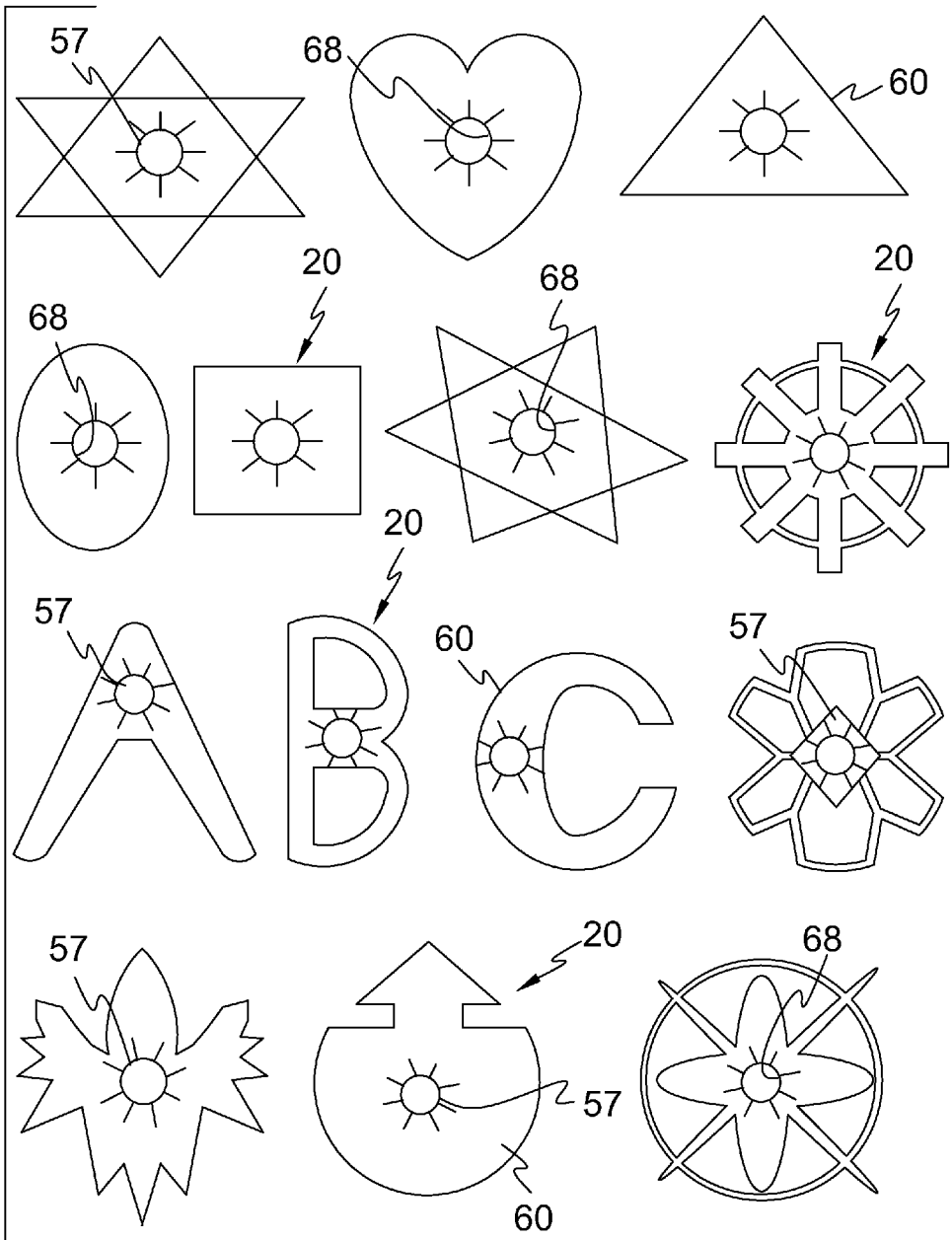
FIG. 14 is a top view of a plurality of shapes for the heel protector.

Referring to FIG. 14, shown is a top view of a plurality of shapes for the heel protector. The present invention envisions that the exterior housing 60 of the heel protector 20 can take any shaped housing 60 providing a receptacle 68 capable of receiving and supporting a heel tip with the heel post receptacle 68 having a plurality of radially positioned inwardly extending stays 57 for gripping a portion of the heel 30.

It will be understood that each of the elements described above, or two or more together may also find a useful application in other types of methods differing from the type described above.

While certain novel features of this invention have been shown and described and are pointed out in the annexed claims, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is new and desired to be protected by Letters Patent and is set forth in the appended claims:

1. A heel guard for a high heel shoe having a heel post which comprises:

a) a base portion having a wider surface then a lower end of the heel post, said base portion being fabricated out of a rigid material; and b) an upper heel clutch portion on the base portion to receive the heel post, whereby when a user of the high heel shoe inserts the heel post within the upper heel clutch portion and applies pressure with the lower end of the heel post on the base portion the pressure will be distributed across the wider surface of the base portion to provide the user with a stabilized walking control over soft and rough terrain;

c) said upper clutch portion being fabricated out of a shape retentive polymeric material that will grip the heel post without marring texture of the heel post and allow the heel post to be easily removed without scratching and damaging the heel post; and d) said base portion having on a top surface a rimmed heel receptacle and a peripheral circumferential ridge with transverse flanges, each terminating in a flange lip, and the upper heel clutch portion having a lower peripheral edge with hook-like catches that matingly engage the base flange lips.

2. The heel guard as recited in claim 1, wherein the base portion further comprises a textured bottom surface having nodules to form a ground engaging frictional component to impede slipping on ice.

3. The heel guard as recited in claim 1, wherein the upper heel clutch portion further comprises a plurality of curvilinear tongue-like stays, with each stay having to frictionally engage the heel post.

4. The heel guard in claim 3, wherein the upper heel clutch portion further comprises a plurality of pliable stay supports to help maintain the stays and accommodate the heel posts of varying thicknesses.

5. The heel guard as recited in claim 1, wherein the upper heel clutch portion comprises a generally dome shaped housing having a central aperture and a plurality of radial slits in the housing extending into the aperture thereby dividing the housing into a plurality of curvilinear sections converging into the aperture to receive and hold the heel post of the high heel shoe therein.

6. The heel guard as recited in claim 1, wherein the upper heel clutch portion comprises an hourglass shaped member with a midpoint constriction that will frictionally engage the heel post, the member having a curvilinear wall forming an aperture with an upwardly depending top portion and a narrower center portion flaring outwardly to receive the heel post therein.

7. The heel guard as recited in claim 1, wherein the base portion and the upper heel clutch portion can be fabricated in a variety of geometric shapes to receive and support the heel post of the high heel shoe.

* * * * *